US005820432A

United States Patent [19]

Wright

[11] Patent Number: 5,820,432

[45] Date of Patent: Oct. 13, 1998

[54] LIFE VEST FOR KAYAKERS

[76] Inventor: Kenneth F. Wright, 1519 S. High School Rd., Indianapolis, Ind. 46241

[21] Appl. No.: 698,725

[22] Filed: Aug. 16, 1996

[51] Int. Cl.[6] ..... B63C 9/08

[52] U.S. Cl. ..... 441/119; 441/88

[58] Field of Search ..... 441/80, 88, 90–92, 441/96, 102–119; 114/347

[56] References Cited

U.S. PATENT DOCUMENTS

| | | | |
|---|---|---|---|
| 371,781 | 10/1887 | Morgan . | |
| 3,046,576 | 7/1962 | Bernhardt | 441/92 |
| 3,064,287 | 11/1962 | Maholm | 441/92 |
| 3,345,657 | 10/1967 | Peeler et al. . | |
| 3,362,034 | 1/1968 | Oldham . | |
| 3,611,460 | 10/1971 | Rossetti | 441/96 |
| 3,771,183 | 11/1973 | Moran | 441/119 |
| 4,498,882 | 2/1985 | Evert . | |
| 4,673,366 | 6/1987 | Hawkins . | |
| 4,722,710 | 2/1988 | Hagen et al. . | |
| 5,098,325 | 3/1992 | Kim et al. . | |
| 5,393,254 | 2/1995 | Ducheshe . | |
| 5,453,033 | 9/1995 | Travinski . | |

FOREIGN PATENT DOCUMENTS

| | | | |
|---|---|---|---|
| 457824 | 9/1913 | France | 441/106 |
| 18005 | of 1908 | United Kingdom | 441/107 |

*Primary Examiner*—Ed L. Swinehart

*Attorney, Agent, or Firm*—Woodard, Emhardt, Naughton, Moriarty & McNett

[57] ABSTRACT

A flotation supplement to a personal flotation device. The flotation supplement has an inflatable buoyancy chamber mountable upon a buoyant life vest. An air storage container is coupled to the inflatable buoyancy chamber to inflate the buoyancy chamber. The buoyancy chamber is laterally offset upon the life vest to provide asymmetric supplemental buoyancy. When not in use, the inflatable buoyancy chamber is stored in its deflated position and releasably restrained to the life vest.

16 Claims, 2 Drawing Sheets

LIFE VEST FOR KAYAKERS

BACKGROUND OF THE INVENTION

The present invention relates generally to personal flotational devices. More particularly, the present invention relates to a supplemental flotation device which is used in conjunction with a standard personal flotational device.

Traditionally, flotation devices have been of two kinds. One kind is a vest or other wearable arrangement of buoyant material. A second type is an inflatable chamber or bladder which is inflated for use or in the event of an emergency. Many of these devices were relatively bulky and restricted a user's movement and flexibility.

The popularity of athletic activities where a personal flotation device is needed, such as kayaking or canoeing, has led to a need for personal flotational devices which are reliable while simultaneously being non-cumbersome and allowing flexibility of movement. By way of example, kayaking is an athletic sport wherein the kayaker's upper body needs to be free and unrestricted in order to paddle, while the kayaker's lower body is constrained within the kayak. Thus, a device is needed which aids the kayaker in the event that the kayak capsizes submerging the kayaker or if the kayaker is trapped in a dangerous above or below water location. Previous designs have provided buoyancy by using bulky buoyant material or by using inflatable chambers; however, these devices do not address the particular concerns of simultaneous reliability and unrestricted movement. Moreover, these devices only provide symmetric flotation and do not aid a user, such as a kayaker, to right a watercraft nor do they have the alternate function of providing an emergency air supply in case of entrapment.

For instance, U.S. Pat. No. 4,673,366 teaches the use of an inflatable chamber which is attached to an exposure suit. In the event of need, the chamber is inflated and surrounds the user's neck and upper chest to provide flotation. This device does not provide buoyancy until inflated, only provides symmetric flotation to the user, and, when inflated, restricts the user's movement.

A separate reference, U.S. Pat. No. 5,453,033 teaches the use of inflatable bladders which are stored in a trouser belt until they are needed. Upon need, the two bladders are inflated and are disposed upon the shoulder of the user. This reference does not teach the use of a buoyant material and only teaches the use of both bladders simultaneously. In this reference the bladders are used as the primary means for buoyancy while restricting the user's movement.

Another aspect of the prior art is taught by U.S. Pat. No. 4,498,882. This patent teaches a hybrid personal flotational device which has a supplemental inflatable chamber attached on top of buoyant material. Upon inflation, the inflatable bladder encircles the user's neck providing symmetric centered buoyancy to raise the head and chest of the user, meanwhile restricting the user's movement.

Consequently, a need exists for a personal flotation device which provides supplemental buoyancy upon need or desire and which does not restrict the movement or flexibility of the wearer. Additionally, there is a need for devices, for people such as kayakers, which supply asymmetric buoyancy for aiding a user to reach the surface of the water, to right a capsized watercraft or for providing a temporary air supply in case of underwater entrapment.

SUMMARY OF THE INVENTION

Briefly describing one aspect of the present invention, there is provided an inflatable buoyancy chamber which is mounted on a personal flotational device such as a life vest. The buoyancy chamber is laterally offset upon the personal flotation device to provide asymmetric supplemental buoyancy. In its non-inflated state, the inflatable buoyancy chamber is restrained in a stored position on the life vest. When activated, air is introduced to the buoyancy chamber and inflates the chamber. The buoyancy chamber then provides asymmetric buoyancy to the wearer. This allows users, such as kayakers, to return to the surface more easily, aids in righting capsized watercraft or may provide a temporary air supply in case of entrapment underwater.

Accordingly, it is an object of the present invention to provide a flotation supplement to a personal flotational device which is inflatable upon desire or in case of emergency.

Another object of the present invention is to provide a flotation supplement which is laterally offset on the personal flotation device to provide asymmetric supplemental buoyancy.

A further object of the present invention is to provide a personal flotation device with a flotation supplement which does not restrict the movement or flexibility of the user.

Another object of the present invention is to provide a personal flotation device which will aid users in righting capsized watercraft.

A still further object of the present invention is to provide a flotation supplement which may be used as an air supply in case of emergency.

Other objects, features, and advantages of the present invention shall become apparent from the detailed drawings and descriptions which follow.

DESCRIPTION OF THE PREFERRED EMBODIMENT

Figure 1:
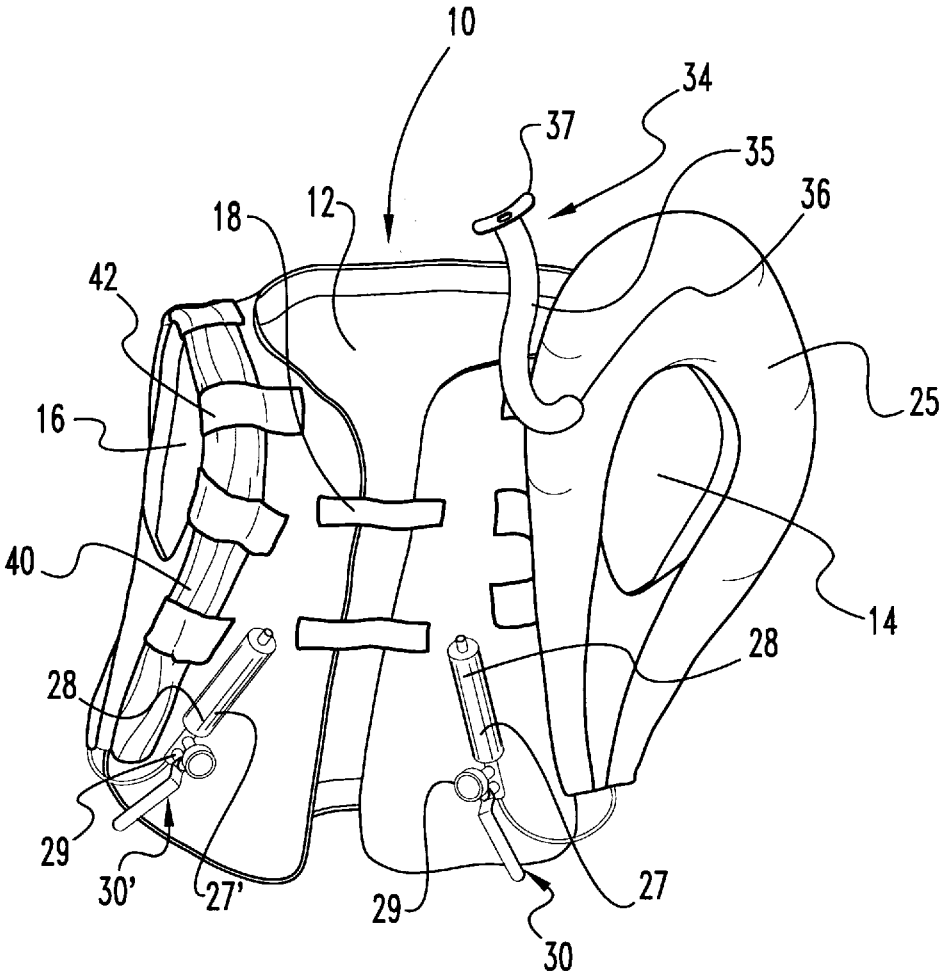
FIG. 1 is a perspective view of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, a perspective view of a preferred embodiment of the invention is shown. In FIG. 1, a buoyancy chamber 25 is mounted laterally offset on life vest 10. The life vest has an opening for a head 12, a first arm hole 14, a second arm hole 16 and closure straps 18. Buoyancy chamber 25 is mounted to life vest 10 and encircles first arm hole 14. Inflation means such as air storage container 27 is mounted to life vest 10 and coupled with buoyancy chamber 25. Air storage container 27 has air storage compartment 28, valve 29 and release mechanism 30. Buoyancy chamber 25 is further provided with air dispenser 34 consisting of air tube 35, air valve 36 and mouthpiece 37.

The stored form of the preferred embodiment is also illustrated in FIG. 1. An inflatable buoyancy chamber 40 is shown encircling second arm hole 16 on life vest 10 and is restrained in its collapsed, uninflated position by flaps 42. An air storage container 27 having an air storage compartment 28 and an output valve 29 is coupled to buoyancy chamber 40 and may be actuated by release mechanism 30.

Figure 2:
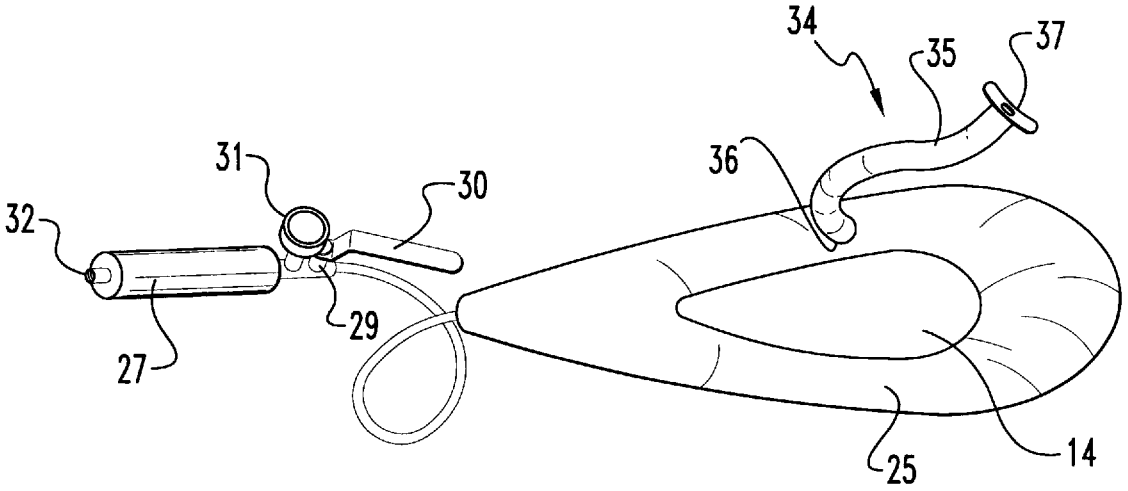
FIG. 2 is an enlarged, perspective, dismounted view of one embodiment of the present invention.

Referring now to FIG. 2, an enlarged perspective view of a preferred embodiment of the invention is shown. Buoyancy chamber 25 encircles first arm hole 14 and is coupled to air storage container 27 through valve 29 and release mechanism 30. Buoyancy chamber 25 is also coupled to an air dispenser 34 consisting of air tube 35, an air valve 36 and a mouthpiece 37. Air storage container 27 has a fill stem 32 and an optional pressure gauge 31.

Figure 3:
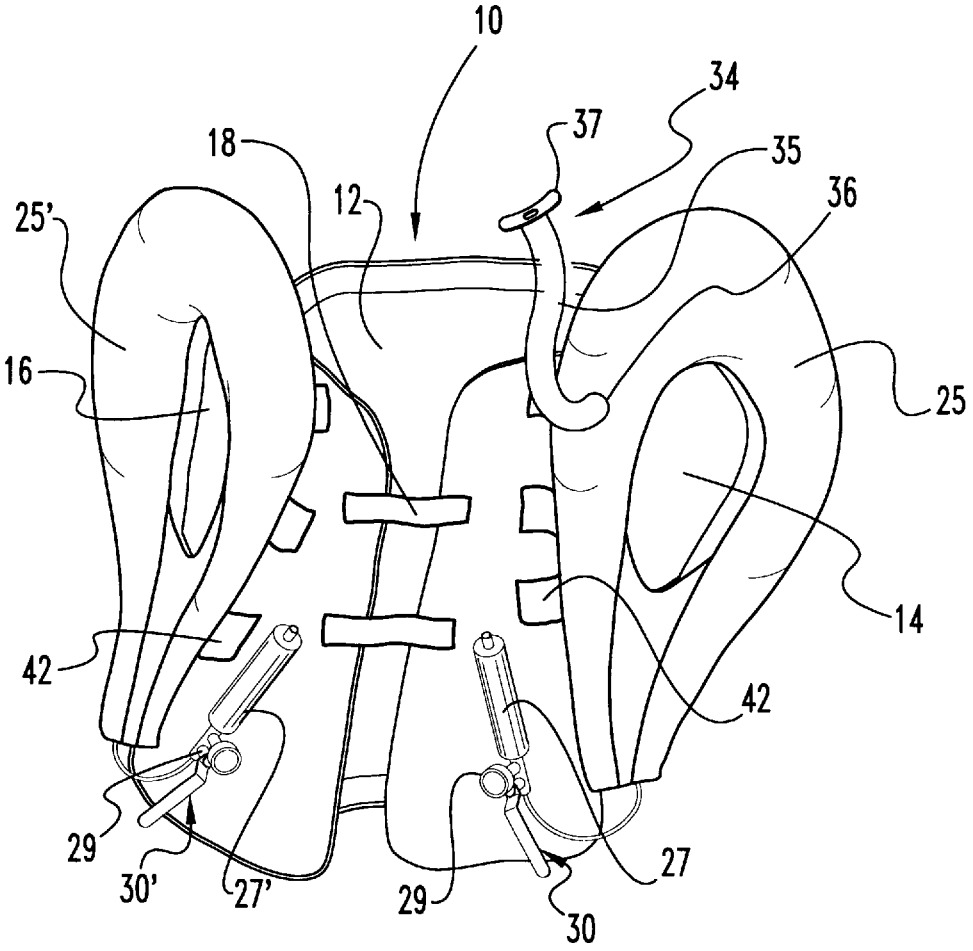
FIG. 3 is a perspective view of a second embodiment of the present invention.

FIG. 3 illustrates a second embodiment of the present invention. Inflatable buoyancy chambers 25 and 25' are mounted and laterally offset on life vest 10. Buoyancy chamber 25' encircles second arm hole 16 of life vest 10. Inflation means, such as air storage containers 27 and 27' are coupled to buoyancy chambers 25 and 25' and may be actuated by release mechanisms 30 and 30'.

Figure 4:
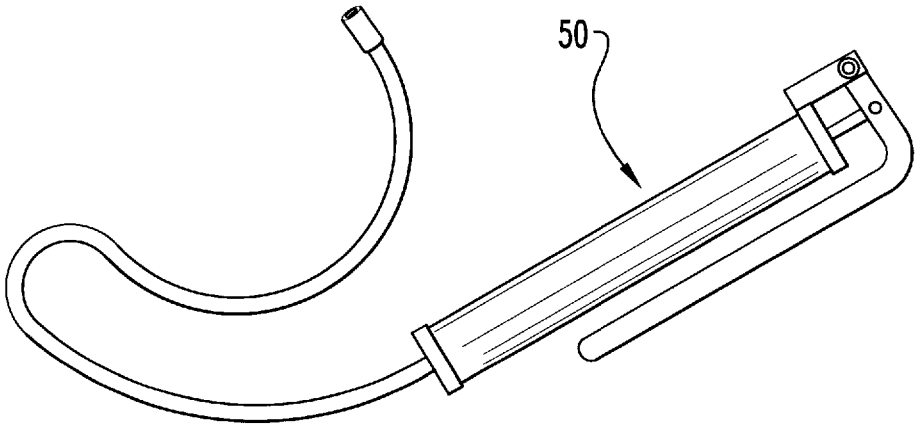
FIG. 4 is a perspective view of an air pump which may be used with the present invention.

FIG. 4 illustrates an air pump 50 which may be engaged with fill stem 32 of air storage container 27.

Having described the configuration of a preferred embodiment of the present invention, the operation of the present invention is next discussed. Initially, buoyancy chamber 25 and air-storage container 27 are mounted on life vest 10. The mounting may be permanent by sewing, gluing or other means of integral attachment, or the mounting may be releasable such as by VELCRO® fasteners, snaps, zippers or other means of releasable attachment. During normal operation, the inflatable buoyancy chamber is stored in a restrained position as illustrated by buoyancy chamber 40 in FIG. 1.

Retaining means such as restraining flaps 42 releasably restrain buoyancy chamber 40 to life vest 10. When supplemental flotation is desired, release lever 30 is used to actuate valve 29. Valve 29 allows the flow of air from air storage container 27 into inflatable buoyancy chamber 25. Inflatable buoyancy chamber 25 is then released from restraining straps 42 and provides supplemental asymmetric buoyancy. This urges the user towards the surface of the water, aids the user to right a watercraft such as a kayak, or supports the user in case of emergency.

In the event that a user is trapped underwater, the preferred embodiment of the invention has the option of an air dispenser 34. The user may use mouthpiece 37 to withdraw air through one-way air valve 36 from inflatable buoyancy chamber 25. As such the buoyancy chamber 25 and the air storage container 27 act as a temporary air supply if the user is trapped underwater.

Before each use of the present invention, an air pump 50 such as is illustrated in FIG. 4 is used to store air in air storage container 27. Air pump 50 is configured to releasably engage fill stem 32 of air storage container 27. In the preferred embodiment of the invention, life vest 10 and inflatable buoyancy chamber 25 are made of standard materials such as plastic, nylon, neoprene or other materials as would be understood by those of ordinary skill in the art. Similarly, air storage container 27, valve 29 and release lever 30 would be understood to those of ordinary skill in the art.

It will be understood that different methods of attaching the buoyancy chamber to the life vest being either permanent attachment or removable attachment are considered to be within the scope of this invention. Similarly other personal flotational devices such as cushions, buoyant belts, or non-"life vest" flotation devices which are used or worn are contemplated by this invention. The inflatable buoyancy chamber 25 may be supplied by an air storage container of compressed air, $CO_2$ or other compressed gases which would provide buoyancy.

The preferred embodiment consists of at least one inflatable buoyancy chamber mounted upon a life vest or flotation device but may consist of two or more inflatable buoyancy chambers to provide additional supplemental buoyancy. It being contemplated that multiple buoyancy chambers may be coupled to separate air storage containers or a common air storage container which may be actuated jointly or separately to inflate the buoyancy chambers.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flotation supplement to a personal flotation device comprising:

an inflatable buoyancy chamber mountable upon a personal flotation device;

inflation means coupled to said buoyancy chamber for inflating said buoyancy chamber;

wherein said buoyancy chamber is laterally offset upon the personal flotation device to provide asymmetric supplemental buoyancy.

2. The device of claim 1 wherein said inflation means is comprised of a pressurized storage container.

3. The device of claim 2 wherein said pressurized storage container is comprised of an air storage compartment, a fillstem, a sealable output valve and a release mechanism for actuating said output valve to allow air to flow from said air storage compartment into said buoyancy chamber.

4. The device of claim 1 further comprising an air dispenser coupled to said buoyancy chamber wherein said air dispenser is comprised of an air tube having a first end coupled to said buoyancy chamber and a second end coupled to a mouthpiece.

5. The device of claim 4 wherein said inflation means is comprised of a pressurized storage container.

6. The device of claim 4 further comprising a one way valve integral with said air dispenser to regulate the withdrawal of air from said buoyancy chamber.

7. A personal flotation device comprising:

a buoyant vest;

an inflatable buoyancy chamber mounted to said vest;

inflation means coupled to said buoyancy chamber for inflating said buoyancy chamber;

wherein said buoyancy chamber is laterally offset upon said buoyant vest to provide asymmetric supplemental buoyancy.

8. The device of claim 7 wherein said inflation means is comprised of a pressurized storage container.

9. The device of claim 8 wherein said pressurized storage container is comprised of an air storage compartment, a fill stem, a sealable output valve and a release mechanism for actuating said output valve to allow air to flow from said air storage compartment into said buoyancy chamber.

10. The device of claim 7 further comprising retaining means mounted on said buoyant vest for releasably retaining said inflatable buoyancy chamber in a deflated position until inflation.

11. The device of claim 7 further comprising an air dispenser coupled to said buoyancy chamber wherein said air dispenser is comprised of an air tube having a first end coupled to said inflatable buoyancy chamber and a second end engaged with a mouthpiece.

12. A personal flotation device comprising:

a buoyant vest;

at least two inflatable buoyancy chambers mounted to said vest; at least one inflation means coupled to said buoyancy chambers for inflating said buoyancy chambers for inflating said buoyancy chambers;

wherein each buoyancy chambers is laterally offset upon said buoyant vest to provide asymmetric supplemental buoyancy.

13. The device of claim 12 wherein said inflation means is comprised of a pressurized air storage container.

14. The device of claim 12 wherein each buoyancy chamber is individually inflatable.

15. The device of claim 12 wherein said buoyancy chambers inflate simultaneously.

16. The device of claim 12 further comprising at least one air dispenser coupled to at least one of said buoyancy chambers wherein said air dispenser is comprised of an air tube having a first end coupled to said inflatable buoyancy chamber and a second end engaged with a mouthpiece.

* * * * *